US005562502A

United States Patent [19]

Kourimsky

[11] Patent Number: 5,562,502

[45] Date of Patent: Oct. 8, 1996

[54] FUSE BOX CONNECTOR ASSEMBLY

[75] Inventor: Friedrich J. A. Kourimsky, Bensheim, Germany

[73] Assignee: The Whitaker Corporation, Wilmington, Del.

[21] Appl. No.: 362,311

[22] Filed: Dec. 22, 1994

[30] Foreign Application Priority Data

Jan. 28, 1994 [GB] United Kingdom ..... 9401647

[51] Int. Cl.[6] ..... H01R 13/68

[52] U.S. Cl. ..... 439/621; 439/949

[58] Field of Search ..... 439/621, 76.2, 439/34, 355, 721

[56] References Cited

U.S. PATENT DOCUMENTS 4,238,140 12/1980 Cairns et al. ..... 439/621

4,555,638 11/1985 Lobe ..... 439/76.2

5,038,050 8/1991 Minoura ..... 439/621

5,088,940 2/1992 Saito ..... 439/621

*Primary Examiner*—Neil Abrams

*Assistant Examiner*—Eugene G. Byrd

[57] ABSTRACT

A fuse box for an automobile comprises assembly modules mountable therein for connecting electrical devices of the vehicle to power supply lines via fuses. Certain fuses are connected to a single electrical devices via conducting wires and other fuses are connected to a plurality of electrical devices by electrical wires. Power is supplied to the other terminal of the fuse via one of various power terminals mounted to the assembly modules and mated to power lines. The plurality of electrical cables for connection to a common fuse, are connected to an IDC branch terminal mounted in a connector module housing, the connector module then pluggable into the assembly module at the vehicle assembly line.

21 Claims, 17 Drawing Sheets

FUSE BOX CONNECTOR ASSEMBLY

BACKGROUND OF THE INVENTION

1. Field of the Invention

This invention relates to a fuse box connector assembly for interconnecting conductors electrical power, to conductors leading to various electrical devices via an electrical fuse, in particular for automotive applications.

2. Description of the Prior Art

In an automobile, it is common to provide a fuse box comprising most of the electrical fuses of the electrical circuitry thereof, such that it is easy to inspect at a glance any blown fuses, as well as facilitating the replacement thereof. FIG. 1 shows the electrical schema of an automobile fuse box, whereby the fuses are indicated by F and are positioned between a power supply line P1, P2 or P3 and output lines L1, L2 or L3. The electrical current supplied through lines P1, P2 and P3 is usually supplied through a relay box, whereby, for example, P1 is a direct line to the positive terminal of the battery, P2 is a power supply only activated after the first turn of the ignition key and P3 is the electrical power supply only once the ignition key is fully turned. The various power supplies ensure that those components that are only supplied with electrical power when the ignition is on, will only receive power through the lines P2 or P3, and those electronic components such as the alarm system or door lights, parking lights, clock etc. will receive power even when the ignition is off by being supplied with the P1 line. The electrical devices being fed by the fuse box, which therefore also acts as a distribution point therefor, are positioned in various zones of the car such as the cockpit, the chassis and the engine compartment. As shown in FIG. 1, a device line Z1 illustrated as a circle indicates a line from the fuse output line L1, L2 or L3 to the cockpit zone, the diamond shape Z2 indicates a line to the engine compartment zone and the fully shaded rectangle Z3 indicates a line to the chassis zone. The unshaded rectangles Z4 are lines not being used but reserved for future applications.

It is usual to group electrical conducting wires into harnesses that are supplied by a harness maker to the automobile manufacturer. The harnesses commonly comprise terminals or connectors at one end for connection to various electrical devices, and terminals at the other end for connection to the fuse box. A harness usually groups wires connected to devices in a same zone of the vehicle in order to make assembly to the vehicle practicable.

In order to economize production and maintenance costs, some of the output lines L1, L2 or L3 are connected to a plurality of electrical devices (and therefore a plurality of device lines Z1, Z2 or Z3), and therefore connected through a single fuse F to one of the power supply lines P1, P2 or P3. The letter T in FIG. 1 indicates the terminal connecting the line L1, L2 or L3 to the fuse F.

Conventional fuse boxes are complicated, expensive to manufacture, bulky, prone to error during the wiring and are difficult to assemble as they usually comprise device lines which comprise conducting wires crimped to terminals, that need to be individually connected to the output lines L1, L2 or L3 at the fuse box. Additionally, output lines leading to different zones of the car Z1, Z2 and Z3 could be all connected to the same fuse as shown by the lines L2 in the dotted boxed area B1 of FIG. 1, these device lines having terminals that are individually connected to the common fuse line L2 only once they have been assembled to the vehicle. The terminals are handled and connected separately, which is not only time consuming, but could easily lead to erroneous connections.

It would be desirable, therefore, to group terminals wherever possible in connector housings such that the number of parts to be coupled during assembly of the vehicle is reduced. Additionally, provision of a connector housing would protect the terminals of harnesses during transport and assembly in the vehicle, as well as allowing the integration of keying means thereon to avoid erroneous connections.

SUMMARY OF THE INVENTION

It is therefore an object of this invention to provide a fuse box connector assembly for connecting electrical devices to electrical supply lines via fuses in a cost-effective manner.

It is a further object of this invention to provide a fuse box connector assembly that is easy to assemble whilst avoiding the possibility of erroneous assembly.

It is a further object of this invention to provide a fuse box connector assembly that is compact.

It is yet another object of this invention to provide a fuse box connector assembly that is cost-effective to produce, easy to assemble and maintain, yet compact and reliable.

DETAILED DESCRIPTION OF THE PREFERRED EMBODIMENT

Figure 1:
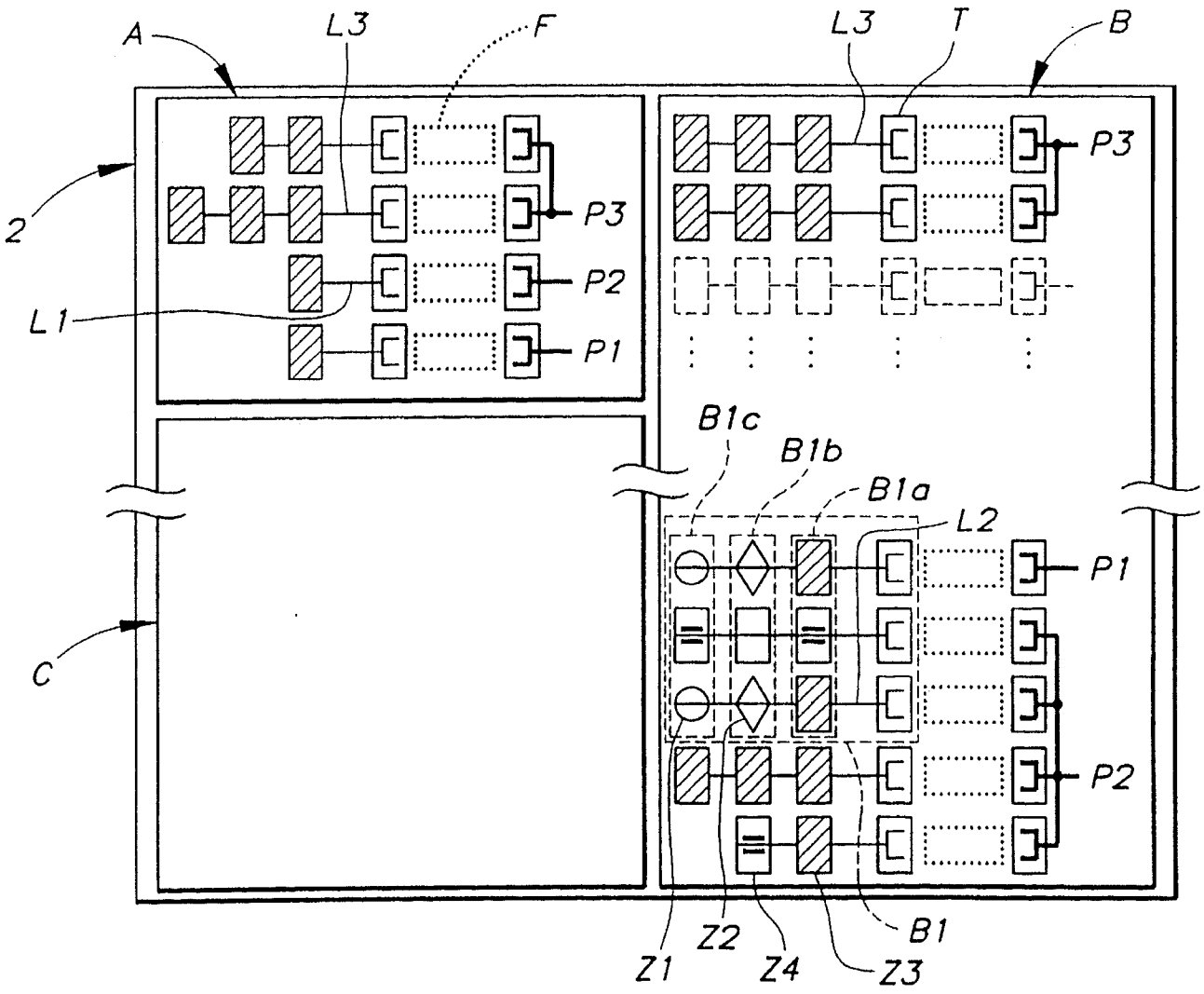
FIG. 1 is an example of a partial electrical schema of a fuse box.

Referring first to FIG. 1, the electrical schema of an automobile fuse box is shown comprising three different power lines P1, P2 and P3 supplying power via fuses F to output lines L1, L2 or L3 which are electrically connected to electrical devices located in different zones of the vehicle. Device lines leading to electrical devices in the cockpit are indicated by a circle and referred to as Z1, those leading to the engine compartment by a diamond shape and referred to as Z2, and finally those leading to the chassis by a fully shaded rectangle referred to as Z3. The unshaded rectangles referred to as Z4 do not correspond to existing lines but are there to indicate a reserve for future applications.

In order to reduce the number of fuses, some output lines such as L1 or L2 are connected to more than one electrical device, e.g. three devices. Certain lines such as L1 are connected to single devices via single device line e.g. Z3 leading to the same zone of the vehicle whereby other lines such as L2 are connected to a plurality of devices via a plurality of device lines e.g. Z1, Z2 and Z3 leading to different zones of the vehicle. As the device lines Z1, Z2 and Z3 each belong to a different harness for assembly purposes, the device lines Z1, Z2 and Z3 must be separately connected to the output line L2 during assembly of the vehicle.

In order to reduce vehicle assembly time and cost, the wiring harnesses of the vehicle are prepared at the harness maker as completely as possible, laid within the car and connected to the electrical devices on the one end and to the fuse box on the other end. To reduce the assembly time, it is therefore necessary to reduce the handling of the harnesses once installed in the car and therefore the number of connections to be made between the harnesses and the fuse box. As will be seen below, reduced handling is effectuated by grouping terminals of the output lines into connector housing modules which can then be simply snapped into place into a fuse box connector assembly module A, B or C within a fuse box assembly represented by the rectangle 2 of FIG. 1.

As already mentioned and shown in FIG. 1, some of the fuses F are connected to only one device line Z1, Z2 or Z3 and some are connected to more than one device line e.g. Z1, Z2 and Z3 as shown by some examples in the broken line box B1. Those devices all leading to the same zone of the vehicle and connected to a common fuse are shown as connected to the fuse via a common line L3. Those fuses connected to a plurality of electrical devices but each leading to a different zone of the vehicle are shown connected to the device lines Z1, Z2 and Z3 via a common line L2. Those fuses connected to a single device (i.e. having only one line Z1, Z2 or Z3 are shown connected to the fuses via lines L1. Dividing the fuse box 2 into separate modules A, B and C facilitates the production and the assembly of the modules into the fuse assembly box in order to reduce production and handling costs, as well as allowing modules to be omitted. Module A, for example, only corresponds to special options, but if these are not required the module A can be omitted thereby reducing costs.

The module A will now be described in detail and is exemplary of embodiments having L1 or L3 lines (or both), i.e. either one device is connected to the fuse F or a plurality of devices leading to the same zone of the car are connected to one of the fuses.

Referring first to FIGS. 2–6 and 9, the module A is shown comprising a housing 10 having power receptacle receiving cavities 12 extending into power terminal receiving cavities 14, single device terminal receiving cavities 16 and connector module receiving cavities 18. Assembled in the module A are power terminals 19, 20 and 21, single device terminals 22, 23 and connector modules 24 comprising housings 26 and plural device terminals 27 mounted therein.

Figure 4:
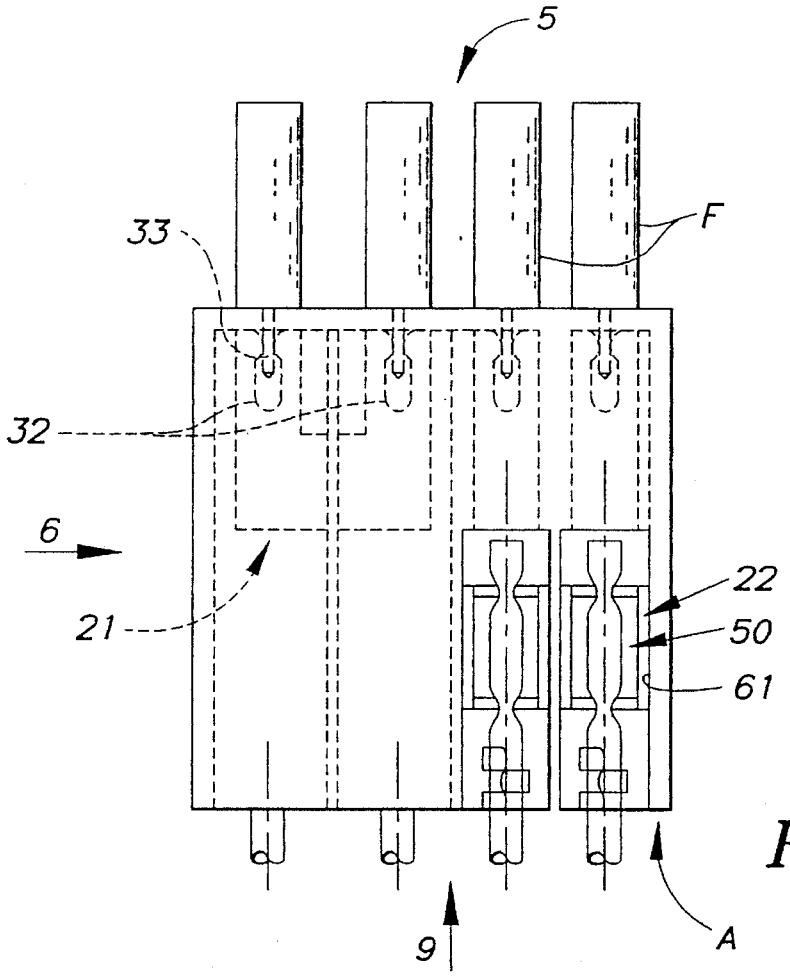
FIG. 4 is a view in the direction of arrow 4 of FIG. 3.
Figure 5:
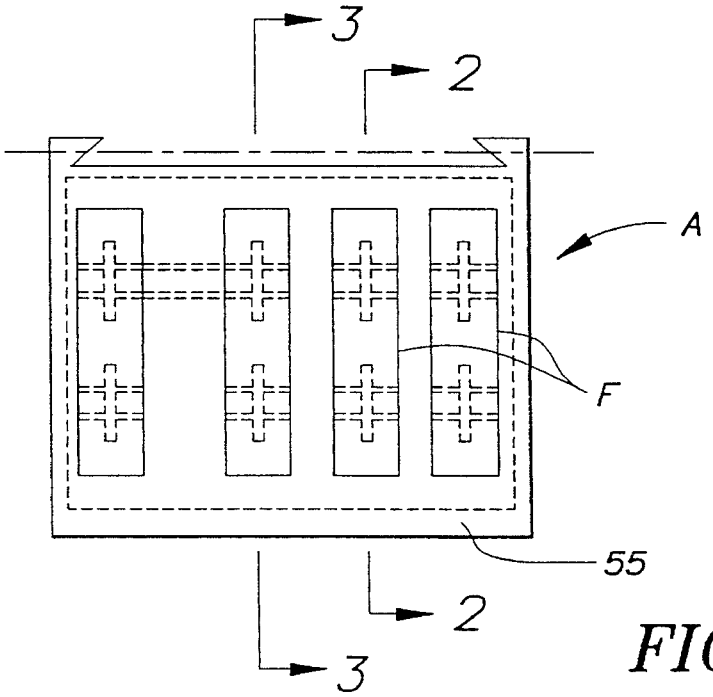
FIG. 5 is a top view of the module in the direction of arrow 5 of FIG. 4.
Figure 9:
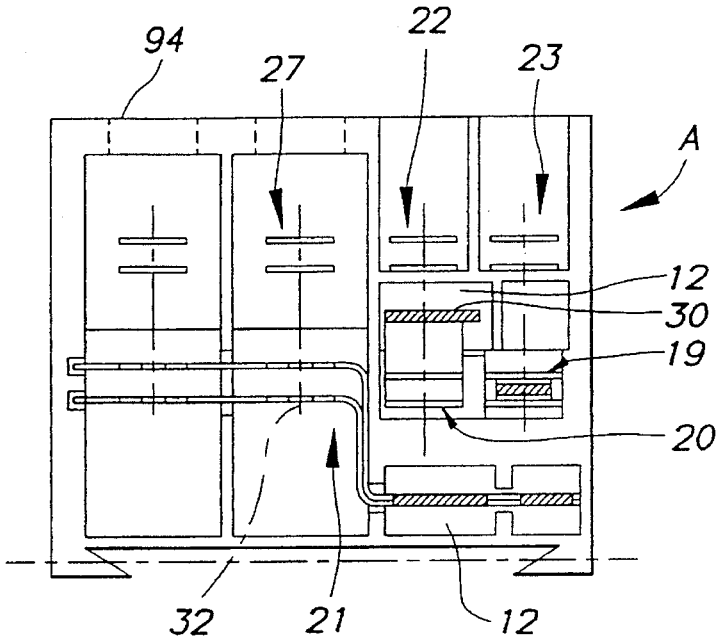
FIG. 9 is a bottom view of module A as shown by the arrow 9 in FIG. 4.

The connector modules 24 comprise keying members 29 extending from a front face 25 of the module, the keying members 29 cooperable with complementary keying members 31 of the module A housing 10 to ensure correct, unique assembly of the connector modules 24 to the assembly module A. In module A there are three separate power terminals 19, 20, 21 for connection to the three different power lines P2, P1 and P3 respectively whereby the power lines consist of conducting wires crimped to receptacle terminals 28 which are received in the power receptacle receiving cavities 12, each power receptacle terminal 28 electrically connected to tabs 30 of the fuse power terminals 19, 20 or 21. As can be seen in FIGS. 4 and 9, (FIG. 9 does not show the power receptacle terminals 28 and the device terminals 22 therein), the power terminal 21 has two pairs of juxtaposed fuse tab receiving contacts 32 for connection to fuse tabs 33. The latter construction corresponds to the P3 power supply line of module A as shown in the electrical schema of FIG. 1.

Figure 22:
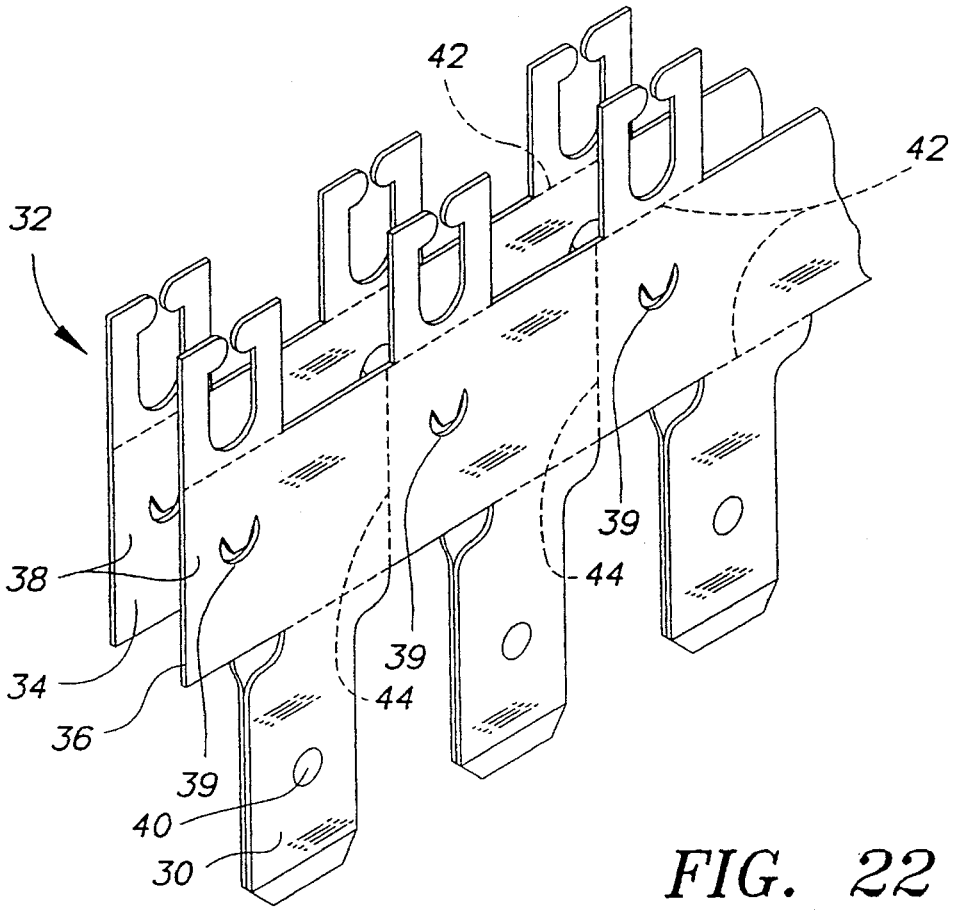
FIG. 22 is an isometric view of a fuse terminal branch connector.

Referring now to FIG. 22, a partially manufactured power terminal 20, 21 or 19 is shown, the power terminals being stamped and formed from two metal sheets 34 and 36 that comprise, at upper ends, the fuse tab receiving contacts 32 joined via a base portion 38 to the tabs 30 that are welded together at a weld 40 for holding together the two strips 34, 36. The contacts 32 or tabs 30 can be cut off from the base portion 38 along cut-lines 42, or the base portion 38 can be cut off along lines 44 so as to provide the appropriate position and number of the tabs as well as the contacts, for example to provide terminal 21 or 30, without substantially changing the stamping and forming tools required to manufacture the terminals. It is a simple and cost-effective solution to provide a common stamping and forming die for the terminals with modifications to the die for removing portions along the cut-lines 42, 44 as opposed to having a separate stamping and forming die for each different terminal e.g. 21 and 30.

Figure 23:
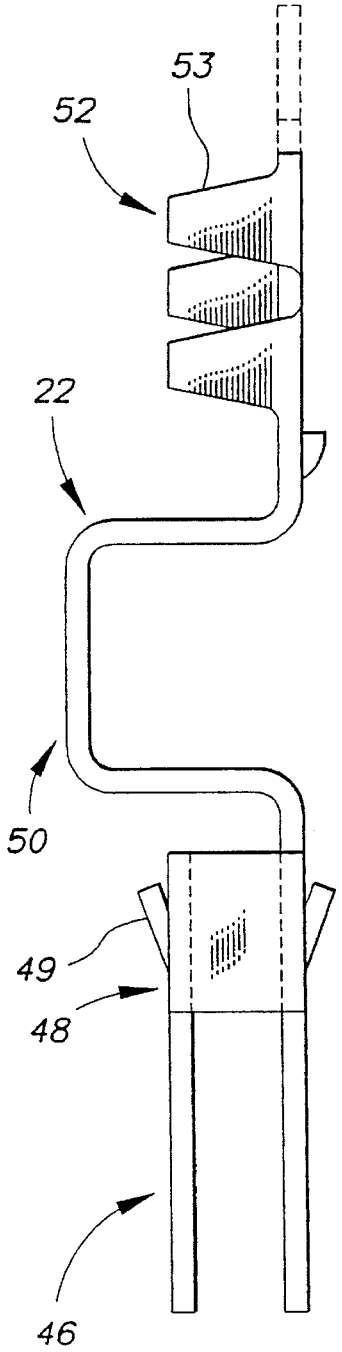
FIGS. 23 and 24 are side and top views of a fuse receptacle terminal for single wire connection.
Figure 24:
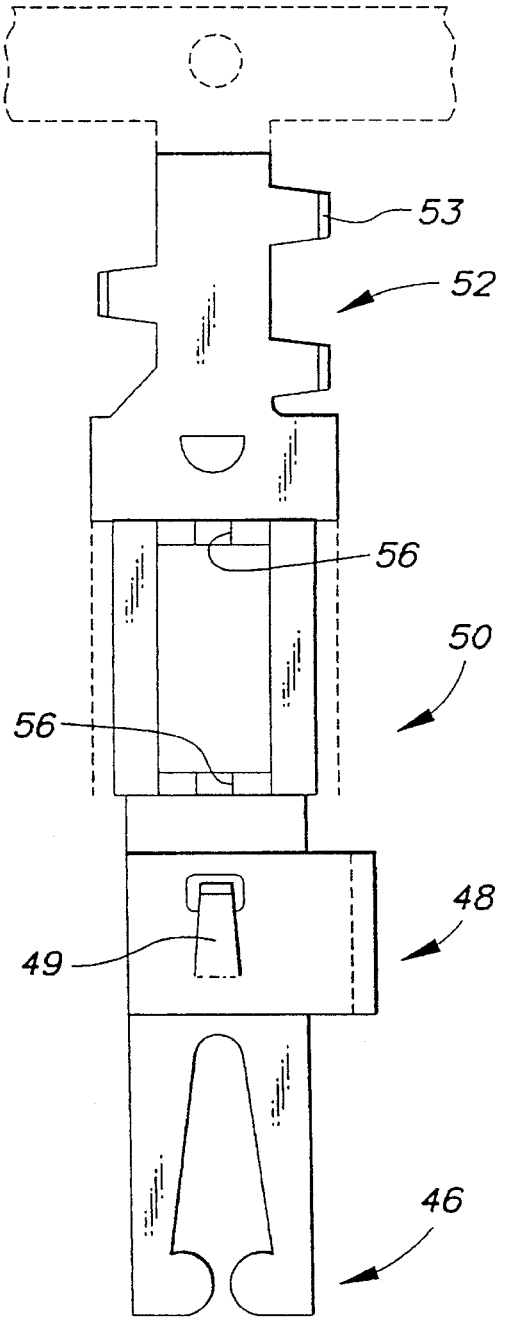

Referring now to FIGS. 23 and 24, the single device terminal 22 is shown comprising a pair of fuse tab receiving contacts 46 extending into a base portion 48 having resilient locking lances 49 thereon, the base 48 extending into an insulation displacing contact (IDC) section 50 that extends into a strain relief section 52 having crimpable arms 53 for crimping around a conducting wire 54 (in FIG. 2) that leads to the corresponding electrical device. In module A, the single device conducting wire 54 corresponds to a Z3 device line. The IDC section 50 comprises a pair of IDC slots 56 for receiving the conducting wire 54 therein to make electrical contact with the conducting strands thereof, in a similar manner to well known IDC connection technology.

Figure 3:
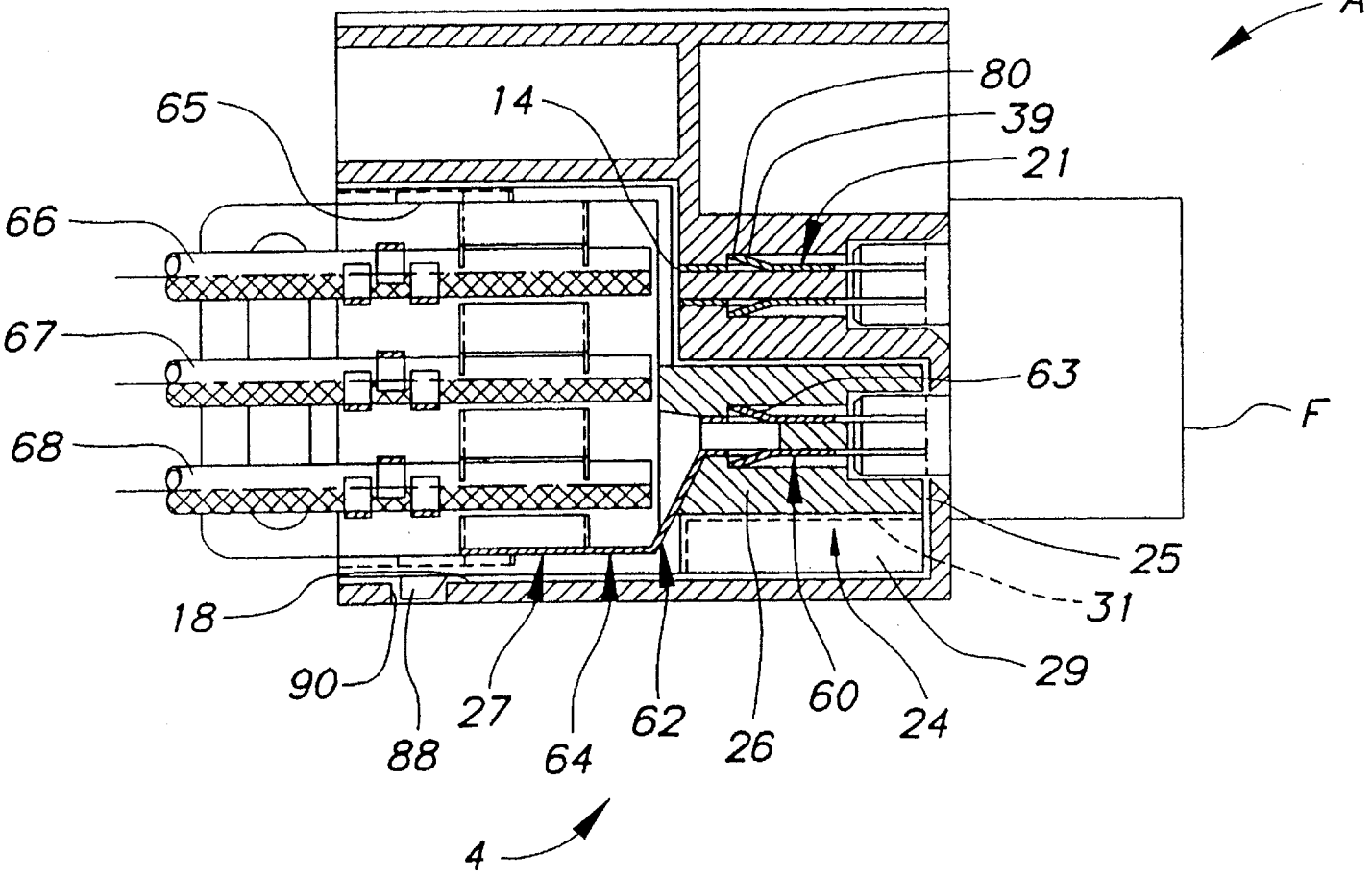
FIG. 3 is a cross-section through the same module shown in FIG. 2 but through lines 3—3 of FIG. 5.

Referring now to FIG. 3, the plural device terminal 27 is shown comprising a fuse tab receiving connection section 60 extending into a base portion 62 which is attached to a branch IDC section 64 for electrically connecting a plurality of conducting wires 66, 67, 68 thereto. Each of the wires 66, 67, 68 leads to a different electrical device, the wires corresponding to Z3 device lines that are connected to the output line L3 of module A.

Figure 8:
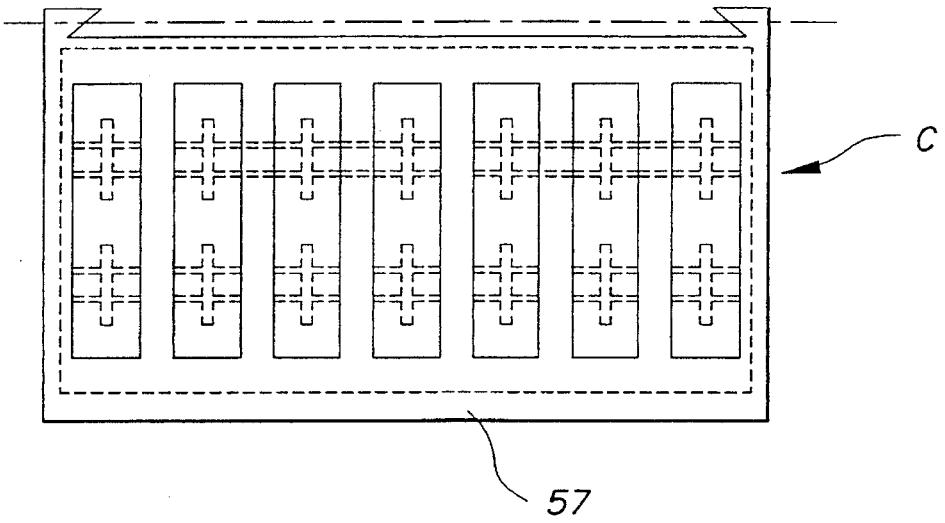
FIG. 8 is a top view of the module of FIG. 7 as shown by the arrow 8 in FIG. 7.
Figure 13:
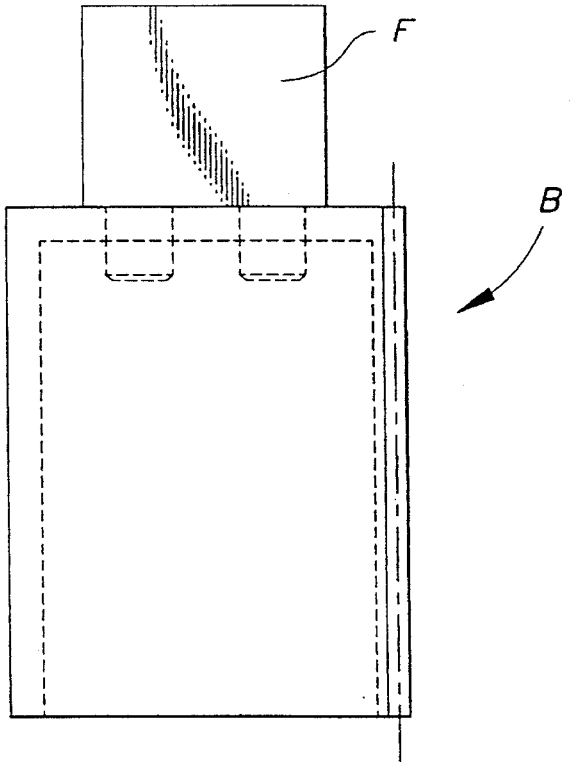
FIG. 13 is an end view of the module B.
Figure 12:
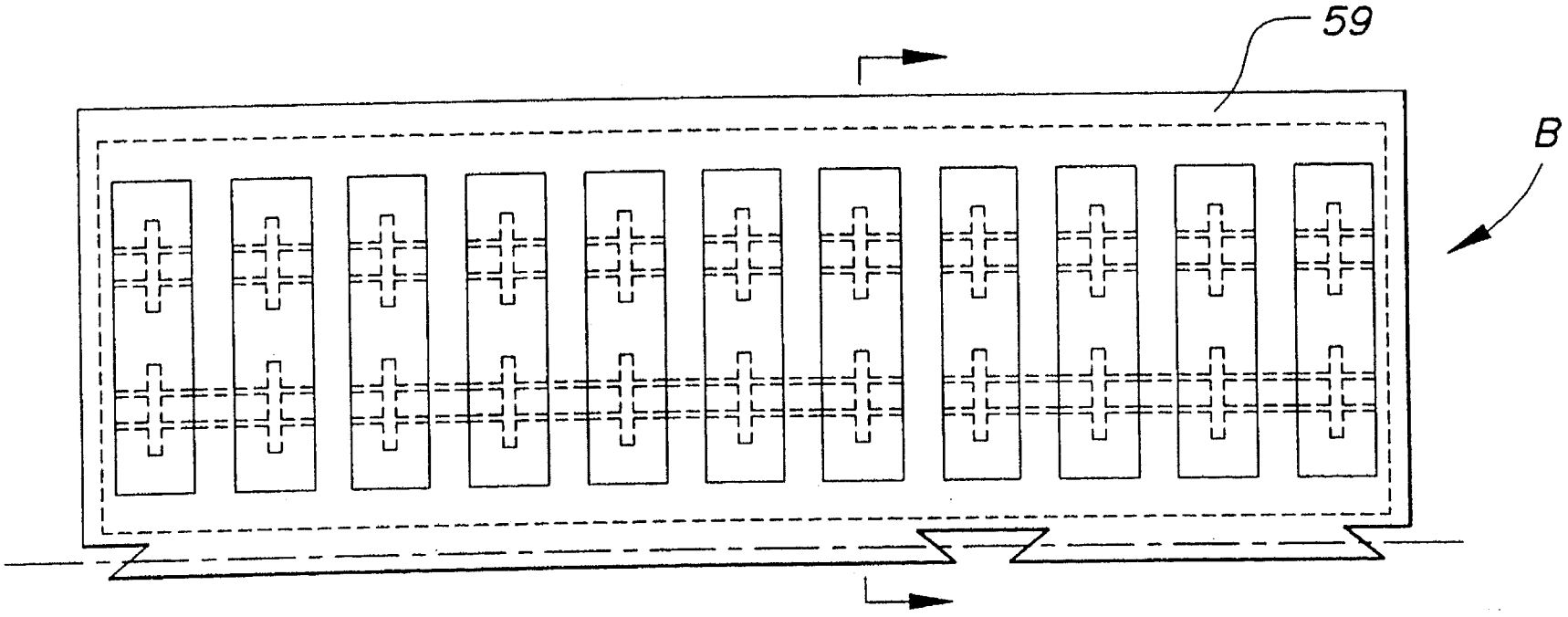
FIG. 12 is a top view of the module B.

Assembly of the module A will now be described. Firstly, the power terminals 19, 20 and 21 are assembled to the assembly module A housing 10 by insertion of the power terminals into their corresponding power terminal receiving cavities 14 until the locking lances 39 engage with retention shoulders 80 of the cavities 14 (see FIG. 3). The single device terminals 22 are also assembled to the assembly module A housing 10 by inserting the terminals 22 into the single device terminal receiving cavities 16 until the locking lances 49 engage against retention shoulders within the cavity 16 for holding the single device terminal therein. At this stage of assembly, the module(s) A (, B and C) can be supplied to the harness manufacturer, which can then connect the conducting wires 54 to the single device terminals by stuffing the wires 54 into the IDC slots 56 and crimping the strain relief tabs 53 around the insulating jacket of the wire. The housings of the modules A, B and C have outer sidewalls 55, 57, 59 respectively (see FIGS. 5, 8, 12 respectively), with cutouts 61 (see FIG. 4) opposite the single device IDC connection sections 50 for allowing passage of the conducting wire 54 and stuffing tool for connection thereto. As all of the electrical devices for connection to module A are found in the chassis of the vehicle i.e. connected only to device lines Z3, the harness manufacturer will prepare the "Z3" harness including all or most of the cables leading from the fuse box to the various devices in the chassis Z3. The harness would comprise electrical connectors on the chassis end for connection to the electrical devices, and on the other end the assembly module A connected to the wires 54 of the "Z3" harness, and possibly also assembly modules B and/or C connected to single device lines in a similar manner to the module A. If the modules B or C have predominance of single device lines that are from the same zone of the car as module A, then they could be connected to the same harness. The modules A, B or C could of course be divided in such a manner that single device lines only from one zone of automobile are connected to any particular module such that all the single device terminals (22) of the module can be connected to conducting wires (54) at the harness manufacturing site. As an example, if a module comprises two single device terminals, one of them connected to a device line Z3 and the other connected to a device line Z1, it would not be possible to terminate both single device wires to the module at the harness manufacturing site because the lines Z1 and Z3 belong to different harnesses which must remain separated until assembled to the automobile.

The harnesses can then be assembled to the vehicle and the modules A, B and C fixed together within the fuse box 2. The modules A, B and C are held together with interengaging dove-tail slots and protrusions (see FIG. 14) 86 and 88 respectively.

The above mentioned "Z3" harness would also include the conducting wires 66, 67 and 68 leading to the plural device terminals 27 whereby the assembly of these can be effectuated independently by first inserting the plural device terminals 27 into the connector module housing 26 until the locking lances 63 engage with retention shoulders of the housing, and then stuffing the wires 66 to 68 into the respective IDC slots of the terminal 27 for electrical connection thereto, as well as crimping the strain relief tabs. The connector module housing 26 has a sidewall having cutouts 65 (see FIG. 3) for access of the wires and stuffing tool to the IDC branch section 64. Thereafter, the IDC branch connector module 24 can be inserted into the corresponding receiving cavity 18 of the assembly module housing 10 whereby the cooperating keying elements 29, 31 ensure that the module 24 is inserted in the correct assembly module cavity 18. The IDC branch connector module 24 is provided with retention protrusions 88 cooperable with a shoulder 90 of the housing 10 for retention of the connector module 24 within the assembly module A. Assembly of the connector module 24 to the assembly module A can either be effectuated at the harness manufacturing site or once the assembly module A is mounted to the fuse box 2, depending on whatever is convenient or possible. The latter would be the case if the assembly module A, B, C were to receive a connector module from a harness (i.e. zone) other than the harness to which the module is preliminarily connected at the harness manufacturing site. For example, a module may be connected primarily to devices in the chassis zone, i.e. Z3, via a first common harness. This first harness could therefore be pre-assembled to the module (A, B or C) in the harness manufacturing site. If the module (A, B, or C) also has some connections to devices belonging to a second separate harness (e.g. going to the engine compartment), then the corresponding wires of the second harness can be preassembled to IDC branch connector modules 24 on the harness manufacturing site, and then plugged into the module (A, B or C) during assembly of the vehicle, when both first and second harnesses are mounted in the vehicle.

Once the assembly module A has been assembled to the other assembly modules B and C and to the fuse box 2, the power receptacles crimped to the power lines (P1, P2 and P3) may then be inserted through the bottom of the fuse box 2 into the power receptacle receiving cavities 12 of the assembly module(s) A (, B and C) for connection to the tab terminals 30.

Figure 7:
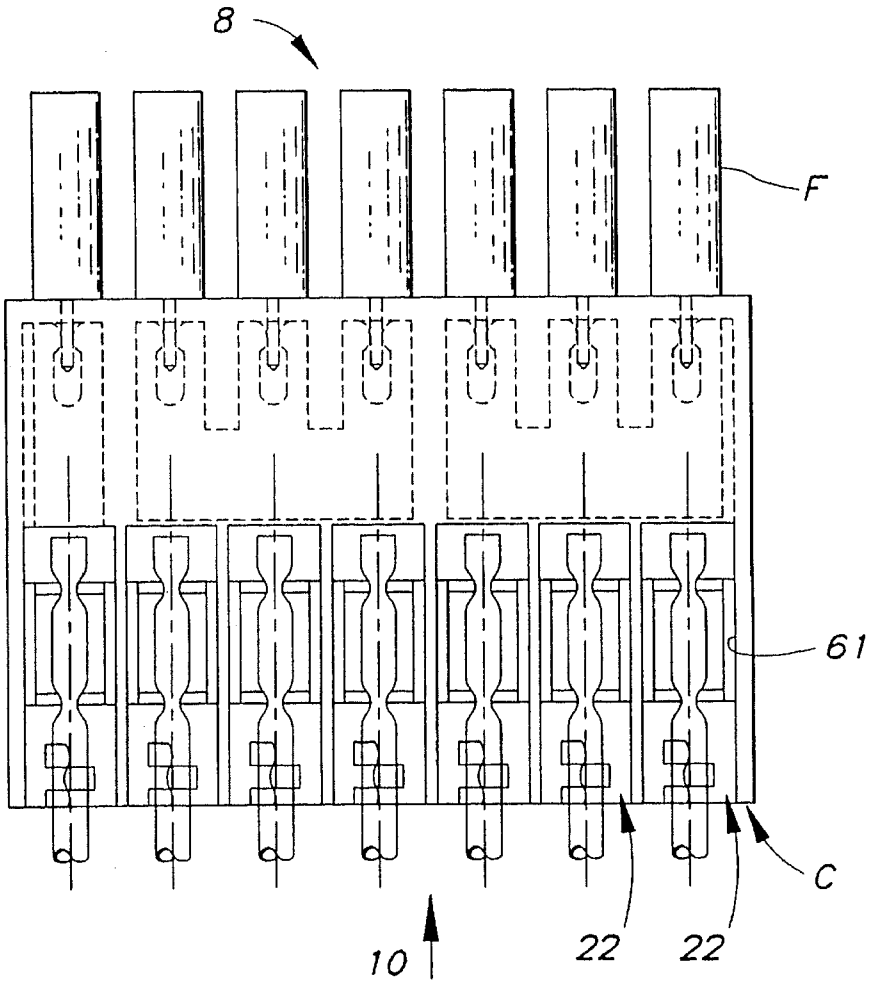
FIG. 7 is a side view of another module C as indicated in FIG. 1.
Figure 6:
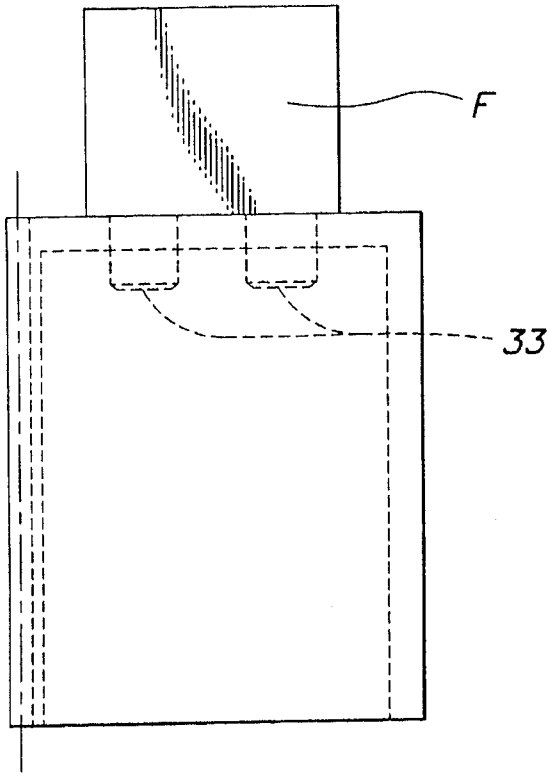
FIG. 6 is an end view of the module in the direction of arrow 6 of FIG. 4.

Assembly of plural and single device terminals to the other modules C and B is effectuated in a similar manner to that already described above for module A. In the case of module C, for example, as shown in FIG. 7, there are only single device terminals 22 for one zone (Z1, Z2 or Z3) to be mounted thereto, whereby the connection of the device lines to the single device terminals of module C is effectuated at the harness manufacturing site and the completely terminated module C is then assembled to the fuse box 2 and secured to modules A and B via the dovetail connections as already mentioned above (also see FIG. 14). Access to the fuse box 2 is provided such that the assembly modules A, B and C and also the various connector modules 24 can be inserted into the fuse box from a lower end for assembly theretogether; the connector modules 24 being rapidly inserted and snap-fitted into their corresponding keyed receiving cavities 18.

Figure 10:
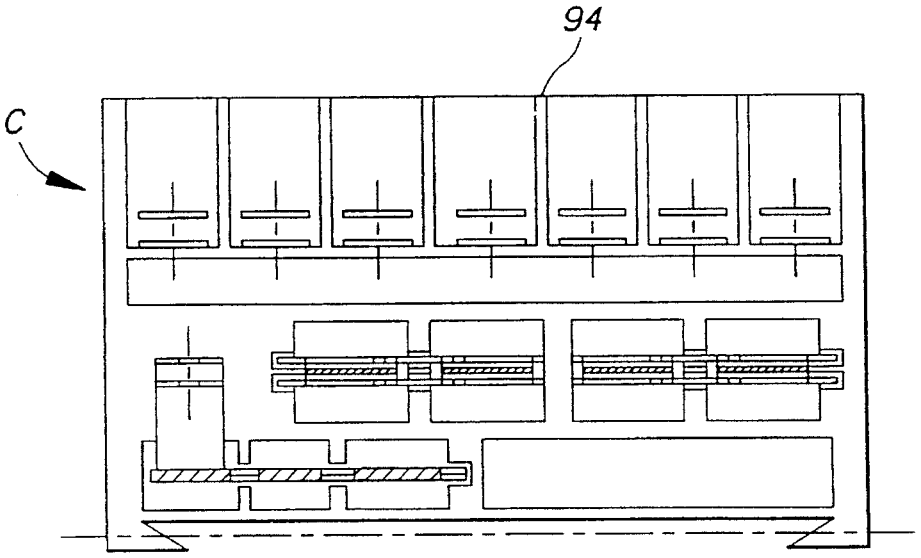
FIG. 10 is a bottom view of the module C as indicated by the arrow 10 in FIG. 7.
Figure 11:
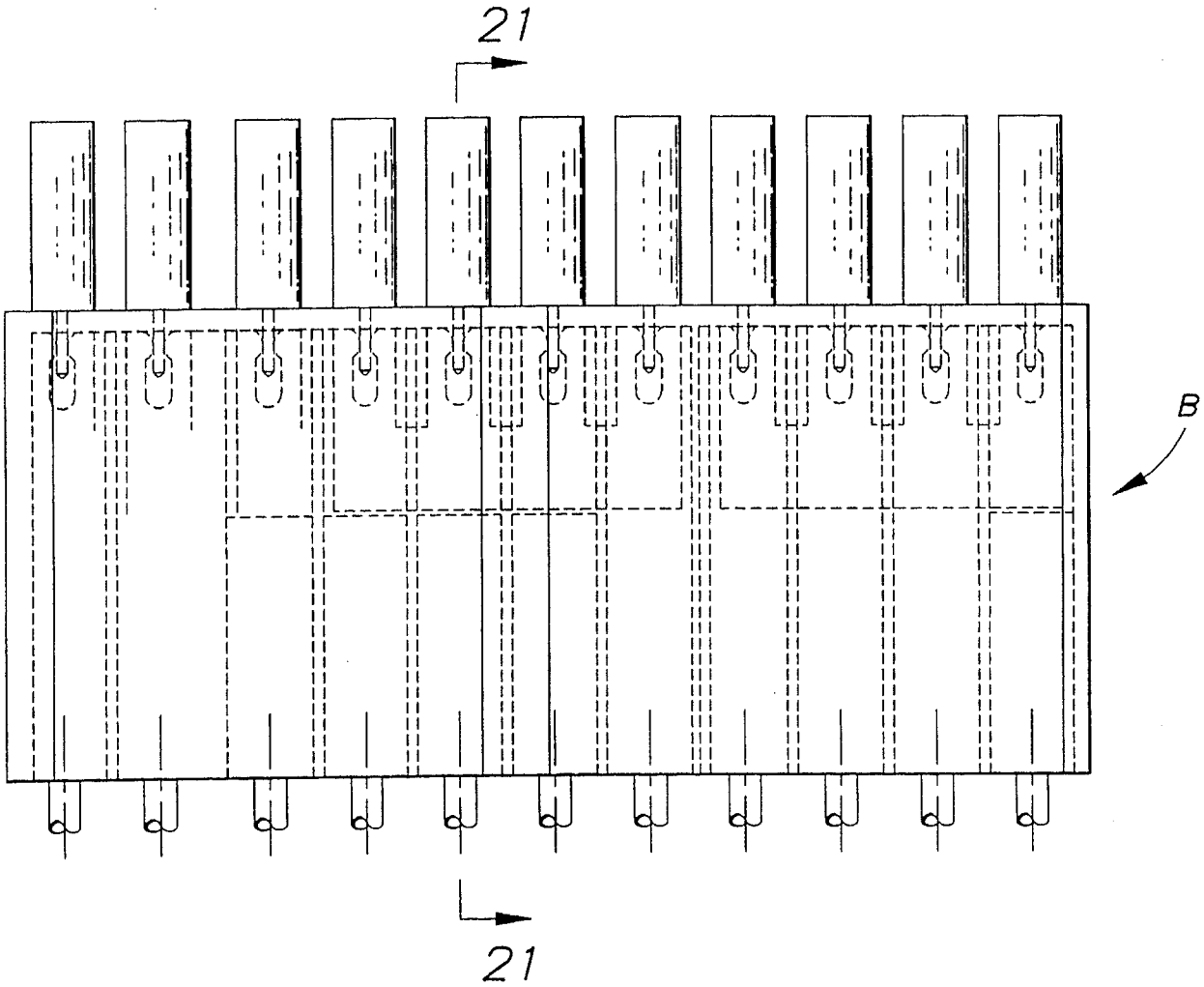
FIG. 11 is side view of another module B as indicated in FIG. 1.
Figure 14:
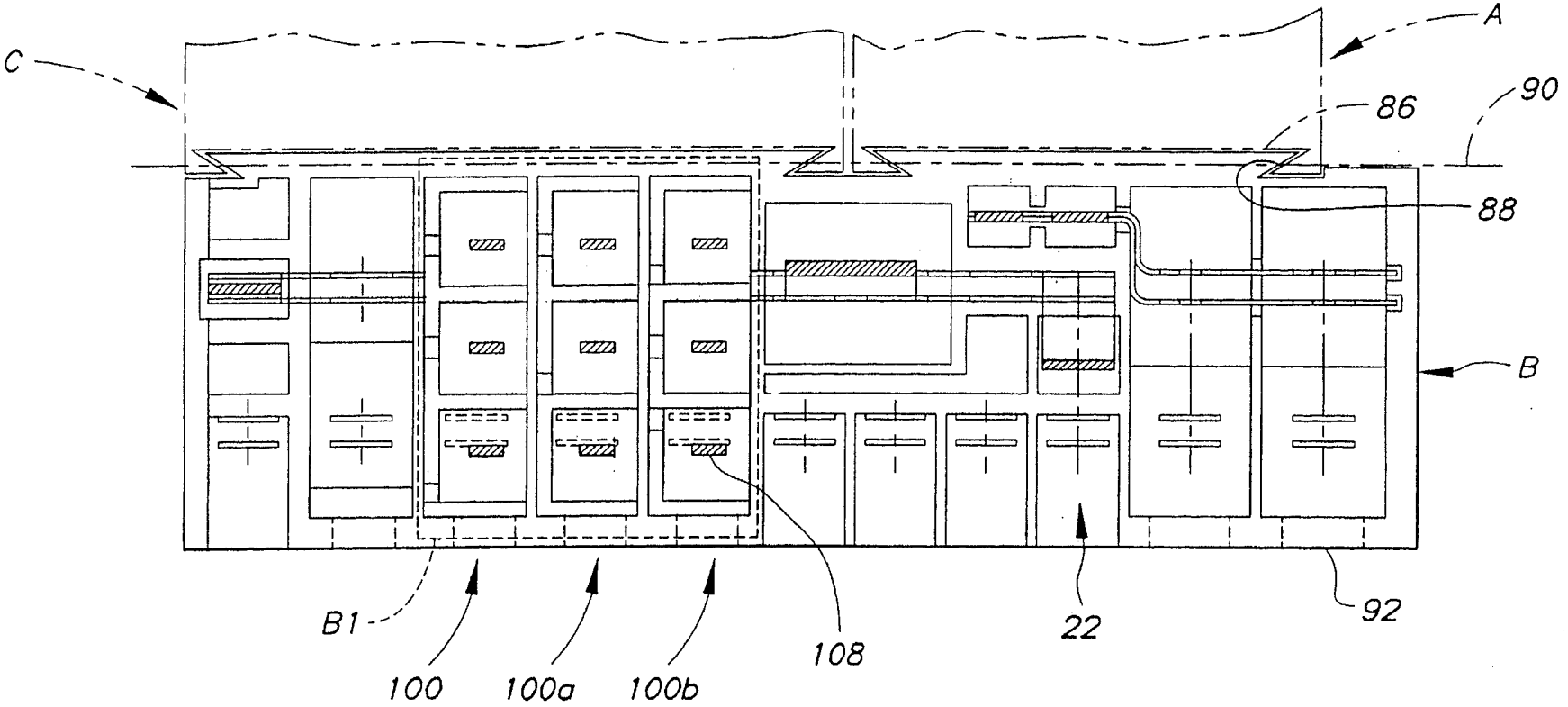
FIG. 14 is a bottom view of the module B.

It should also be noted, that the assembly modules A, B and C are arranged in such a manner that the power terminals are disposed substantially around and proximate a centre-line 90 (see FIG. 14) separating the modules A, C and the one hand and B on the other hand, whereby the single device terminals 22 face outer opposing sides 92, 94 (see FIGS. 9, 10 and 14). The latter not only avoids messy and complicated wires by clearly separating power and device lines, but also allows easy access for IDC connection and disconnection of the single device wires 54 to the single device terminals 22 for IDC connection thereto.

Figure 16:
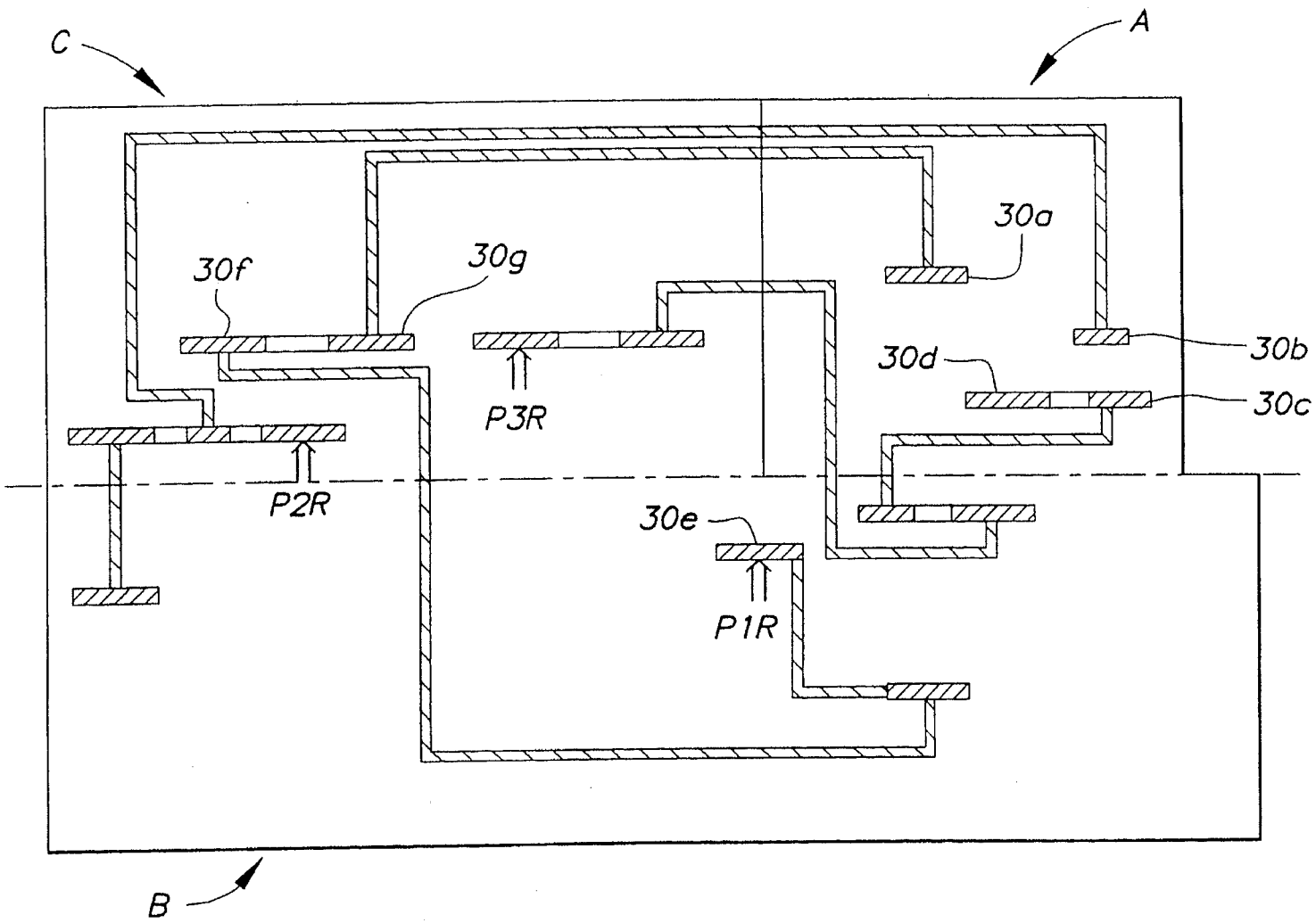
FIG. 16 is an electrical path schema of the power supply lines of the modules A, B and C.

It is important to separate the power lines and device lines and will be explained by referring to FIGS. 9, 10, 14 and 16 whereby FIG. 16 shows the distribution of the power supply from the three incoming power lines P1, P2 and P3 which come from a relay box (not shown ). In this example, the power supply is distributed within the fuse box rather than feeding a great plurality of power lines from the relay box. Only three lines P1, P2 and P3 carrying the required currents for all of the electrical devices being supplied from the fuse box, are fed from the relay box. The lines incoming from the relay box are illustrated in FIG. 16 by the arrows indicated P1R, P2R and P3R, and each consist of a conducting wire having the required cross-section for carrying the necessary current for the whole fuse box, the wires crimped to a receptacle terminal such as terminal 28 shown in FIG. 2 but possibly of larger dimensions.

Figure 2:
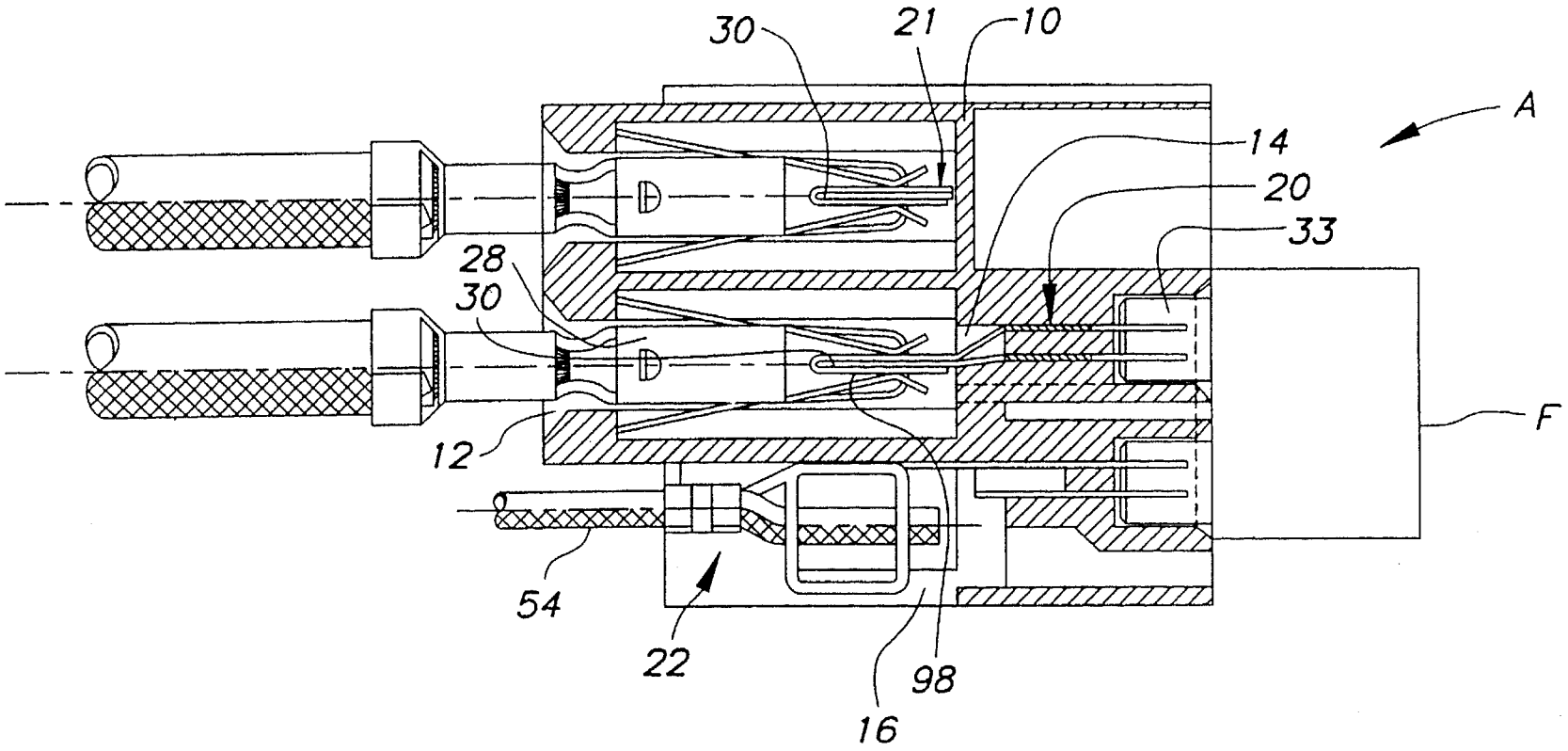
FIG. 2 is a cross-section through a fuse box connector assembly module through lines 2—2 of FIG. 5.

As can be seen in FIG. 16 and FIG. 9, module A has four separate tabs 30 (shown cross-latched in FIG. 9) for receiving power receptacles 28 in cavities 12, the four different tabs 30 being denoted by 30*a*, 30*b*, 30*c* and 30*d* for differentiation purposes. The tab 30*a* is supplied by the incoming power supply line P1R connected to a power terminal tab 30*e* in the assembly module B. The tab 30*e* is connected via a conducting wire to a tab 30*f* in module C, which is unitary with another tab 30*g* by a terminal construction as shown in FIG. 22, which is connected via a conducting wire 26 to the tab 30*a*. The conducting wires having the receptacle terminals 28 as shown in FIG. 2 for connection to the tabs 30*a*–30*e*. There is thus only three incoming power supply lines P1R, P2R and P3R, whereby power distribution is done within the fuse box.

In order to economize manufacturing costs, the power terminals 19, 20 and 21 are manufactured from sheet metal stock of the same thickness, however the current carrying needs of the various power terminals may be quite different, and those power terminals carrying very high current (for example 30*e*) may have additional thickness by folding over an additional strip 98 of the tab 30 as shown in FIG. 2. Additionally, the size of the receptacle terminals 28 for connection to the tab terminals 30 will be sized according to the electrical current carrying requirements.

As opposed to connecting individual conducting wires 26 between the power terminals of modules A, B and C, it would also be conceivable to provide a preassembled connector assembly connected to the lines P1R, P2R, P3R, and having a distribution circuit and receptacle terminals matable with the terminals 30*a*–*e*. Such a connector assembly would be rapidly and simply pluggable to the power terminals as a single unit, this connector assembly unit being manufactured at a more appropriate sight in order to further reduce the wiring assembly of the fuse box 2 at the automobile manufacturing location. For the latter, it is a great advantage to have the power terminals grouped together about the centre line 90 without crossing over the device lines.

Referring back to FIG. 1, it has already been mentioned that some fuses are connected to a plurality of electrical devices situated in different zones of the vehicle such as those depicted within the dotted rectangle B1 in module B. The conducting wires leading to different zones of the vehicle will belong to different harnesses and are therefore assembled to the vehicle independently. They can therefore only be connected to the assembly module B at the automobile assembly site rather than at the harness manufacturer. As has already been mentioned, it is desirable to reduce not only the assembly time of the electrical connections of box B1, but also to eliminate the risk of erroneous connections between the fuse box and electrical devices. The latter is achieved by grouping those device lines leading to common zones Z1, Z2 or Z3 of the vehicle in a connector module that can be assembled to the assembly module B in a rapid, simple and error-free manner as will now be described by referring to FIGS. 14–21.

Figure 17:
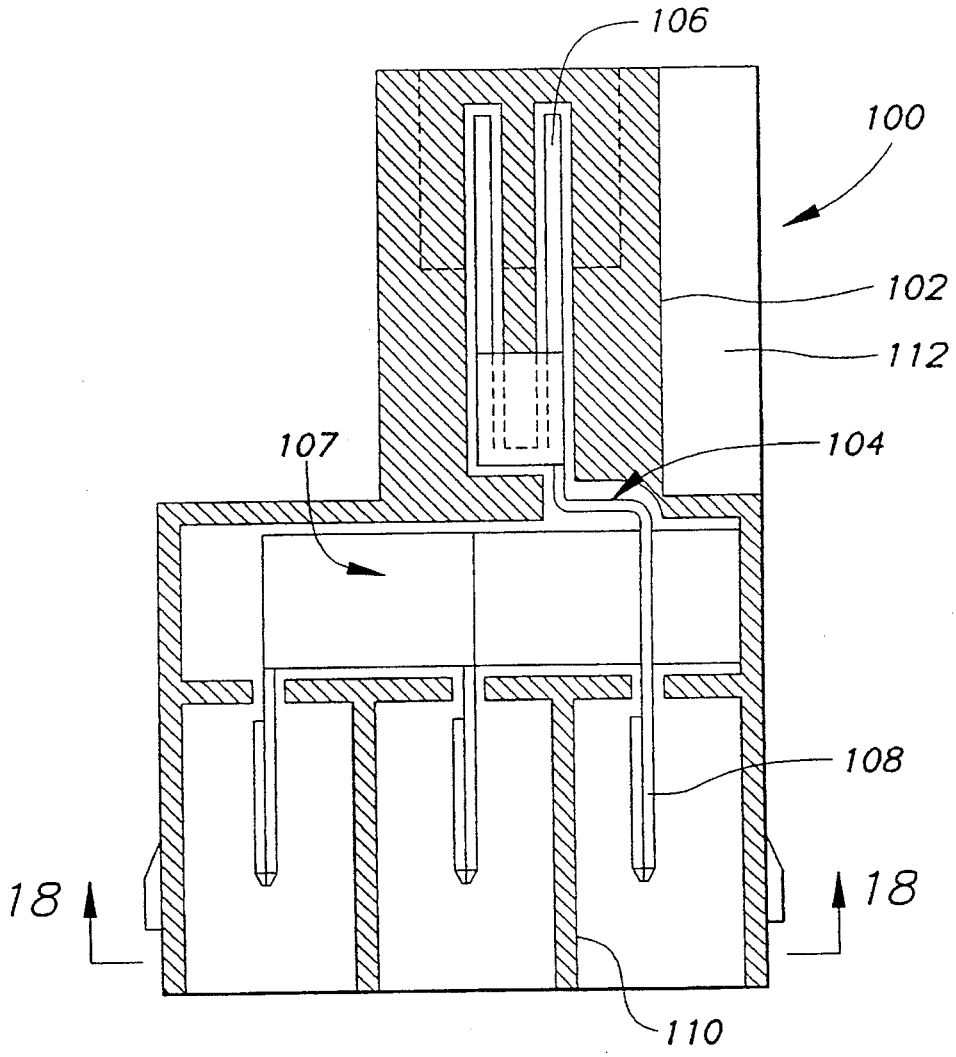
FIG. 17 is a cross-sectional view through a fuse connector module mountable in the assembly module B.
Figure 18:
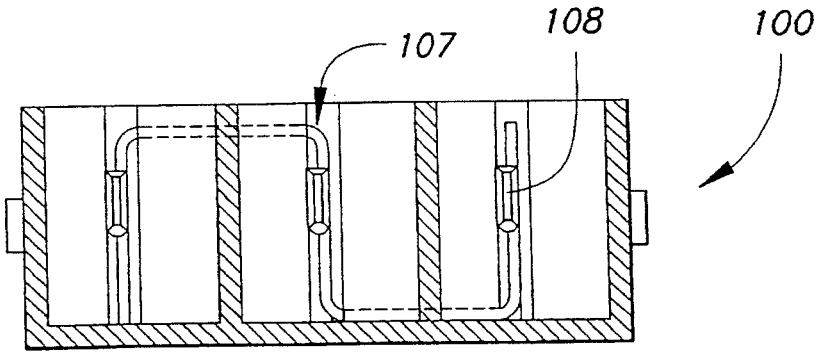
FIG. 18 is a cross-sectional view through lines 18—18 of FIG. 17.
Figure 21:
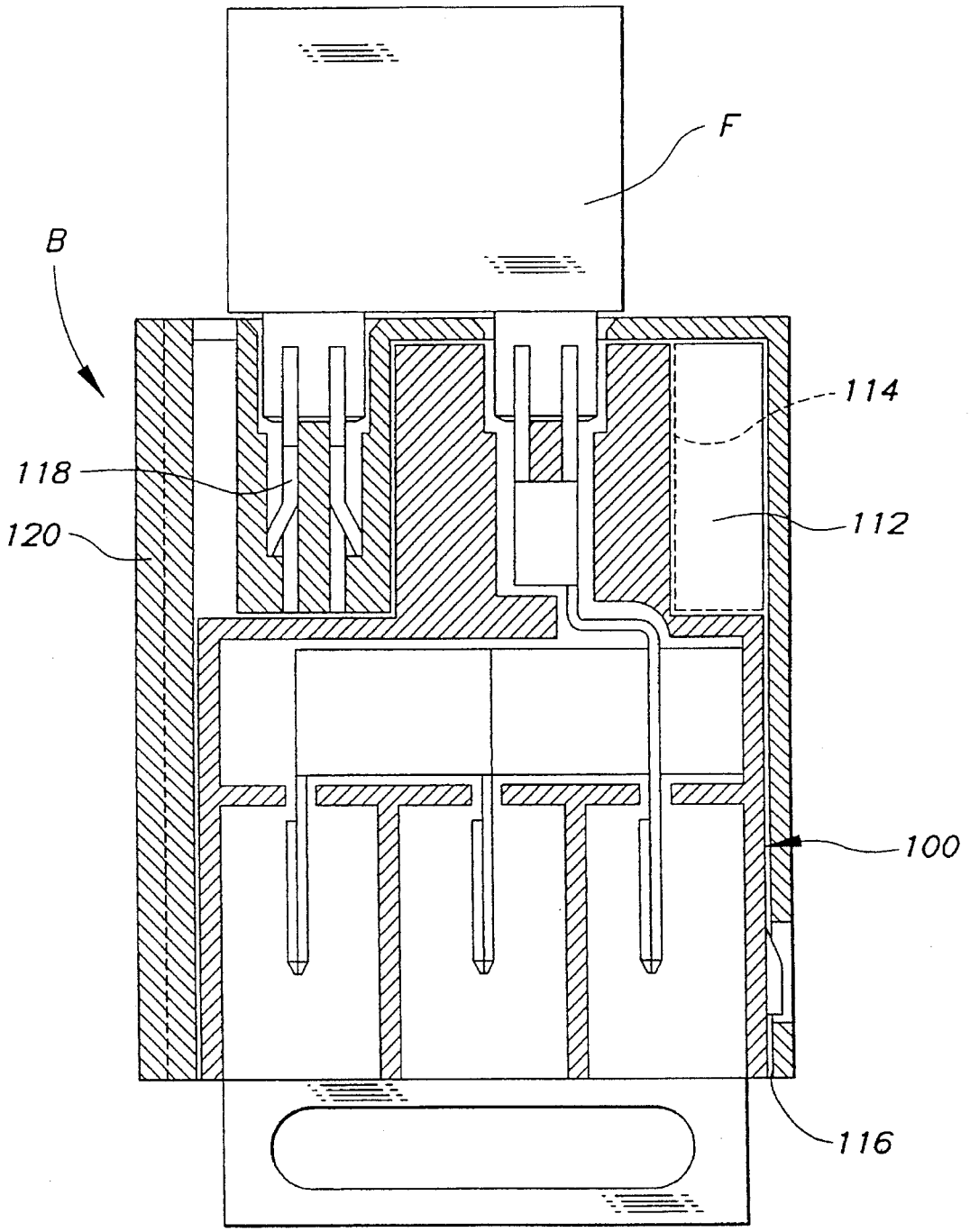
FIG. 21 is a cross-sectional view through line 21—21 of FIG. 11 showing the connector module of FIGS. 17–19 mounted in the assembly module B.

Referring first to FIGS. 17 and 18, a connector module 100 is shown comprising a housing 102 and a tab branch terminal 104 having a fuse tab receiving contact section 106 extending into a base portion 107 which then extends into a plurality of male tabs 108 separated by tab separation walls 110 of the housing 102. The housing 102 comprises a keying member 112 cooperable with a complementary keying member 114 (see FIG. 21) of the module housing for correct assembly of the connector module 100 into the assembly module B. The tabs 108 are electrically and mechanically connected to the fuse tab receiving contact section 106 by the base portion 107, the tabs 108 therefore corresponding to output connection points for the devices lines in zones Z1, Z2 and Z3 that are connected to a common fuse F as seen in the rectangle B1 of FIG. 1. As shown in FIG. 21, the connector module 100 can be assembled to the assembly module B by simply inserting the connector module 100 into a connector module receiving cavity 116 after having preassembled power terminals 118 to a housing 120 of the assembly module B in a manner similar to that already described for the assembly of module A. In the case of module B, however, the connector modules 100 can be preassembled to the assembly module housing 120 at the connector manufacturing sight.

Figure 19A:
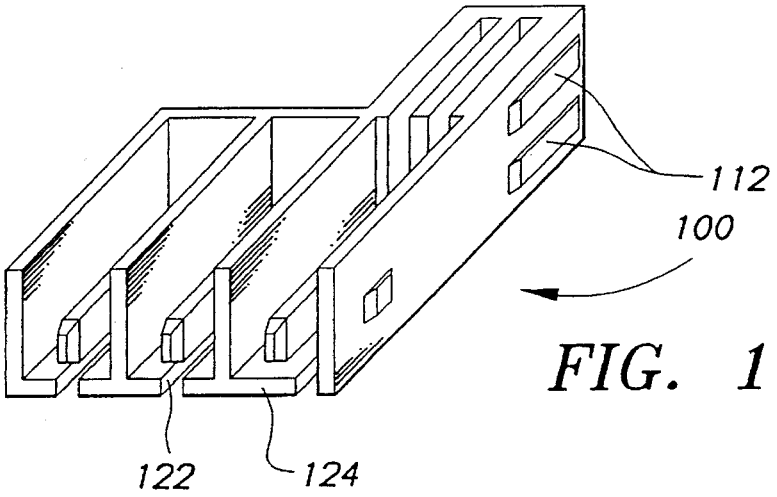
FIGS. 19*a*–19*c* are isometric views of various connector modules similar to that shown in FIG. 17, for stacking together, the various connector modules having differing keying slots.
Figure 19B:
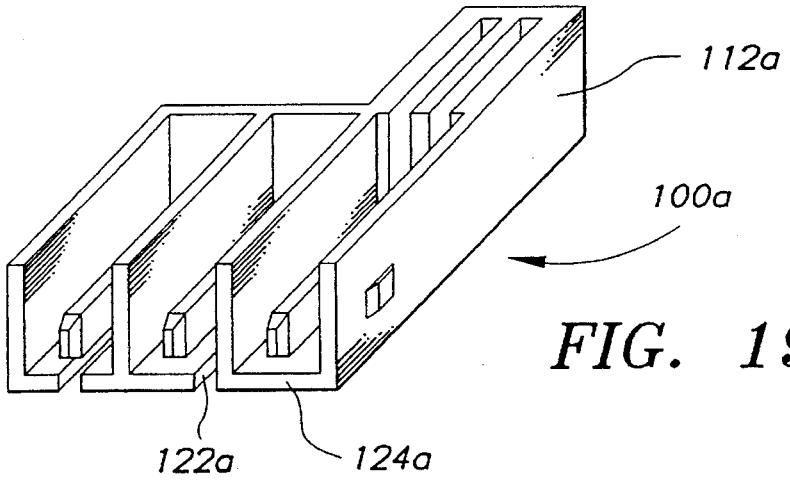
Figure 19C:
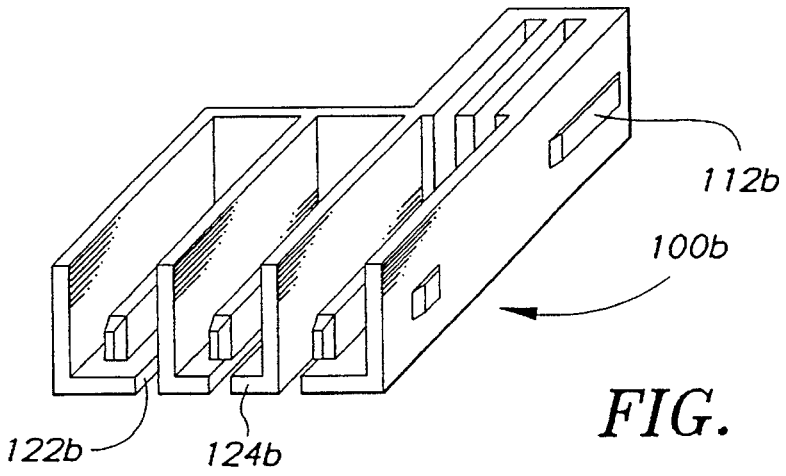
Figure 20C:
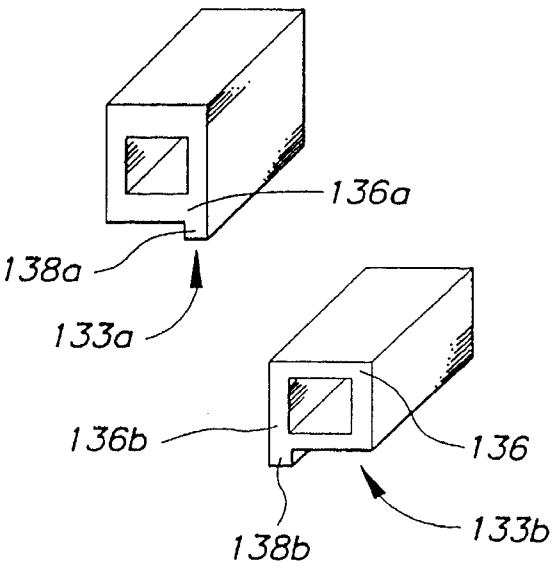
FIGS. 20*a*–20*c* are isometric views of the connector modules as shown in FIG. 5 for coupling to the stacked connector modules of FIG. 19*a*–19*c;*
Figure 20B:
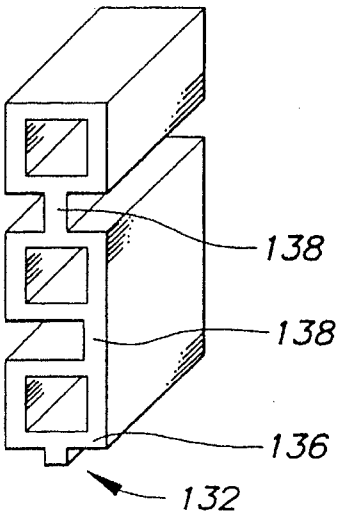
Figure 20A:
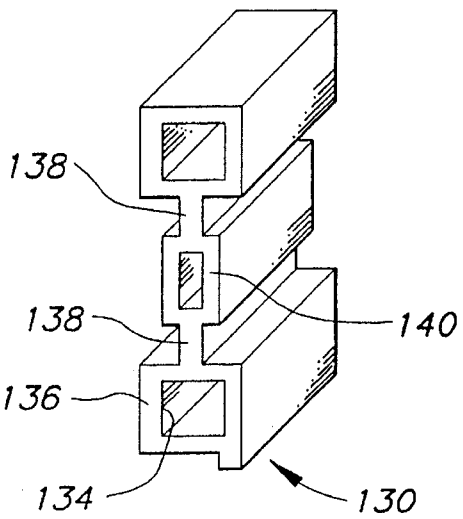

Referring now to FIGS. 19*a*–19*c*, two other connector modules 100*a* and 100*b* are shown, the latter being very similar to the connector module 100 but having slots 122*a*, 122*b* in base walls 124*a*, 124*b* of the connector module housings 112*a*, 112*b* respectively, that are positioned differently to slots 122 in a base wall 124 of the connector module 100. The connector modules 100, 100*a* and 100*b* are all mountable into the assembly module B housing 120 in a juxtaposed manner as shown more clearly in FIG. 14, and provide connection points for the nine device lines shown in the rectangle B1 of FIG. 1. Referring now to FIG. 15 and FIGS. 20*a*–20*c*, common zone connector modules 130, 132, 133*a* and 133*b* are shown, the connector modules 130–133*b* comprising terminal receiving cavities 134 therein for receiving receptacle terminals matable with the male tab terminals 108 of the connector modules 100–100*b*, the terminal receiving cavities 134 surrounded by terminal housing sections 136 that are joined together by keying webs 138 in the case of modules 130 and 132. Terminal housings 136*a* and 136*b* of modules 133*a* and 133*b* respectively are not joined together but nevertheless have keying protrusions 138*a* and 138*b* respectively. The central housing section 140 of connector module 130 does not receive a receptacle terminal, but nevertheless has a cavity 142 therethrough for receiving one of the tabs 108 when the module 130 is assembled to the assembly module box B1. The position of housing section 140 corresponds to an output connection for a device line Z3 not currently being used, and therefore not requiring a terminal.

Figure 15:
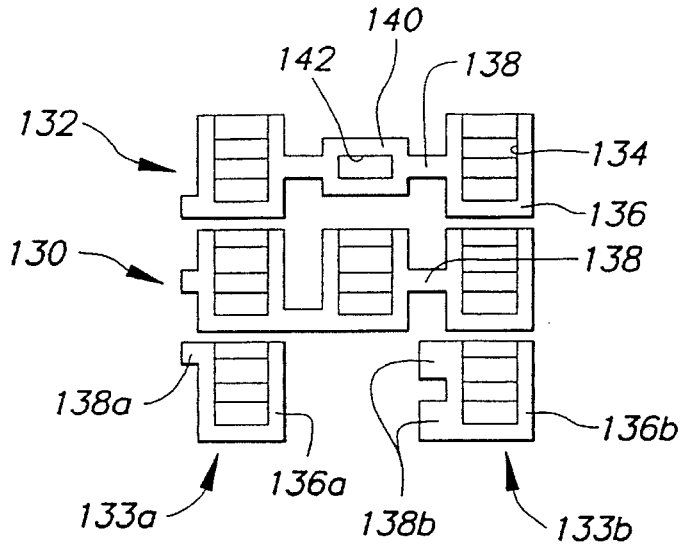
FIG. 15 shows connector modules mountable in the assembly module B and connected to wires from different zones.

The connector module 130 receives receptacle terminals connected to device lines Z3 and corresponds to those devices found in column B1*a* of box B1 shown in FIG. 1, whereby the connector module 132 is for connection to device lines Z2 found in column B1*b* and modules 133*a*, 133*b* are connected to device lines Z1 as shown in column B1*c* of FIG. 1. The connector module 130 can thus be preassembled to the harness for the electrical devices found in the chassis zone, at the harness manufacturing sight and likewise the module 132 can be preassembled to the harness of the cockpit zone. Assembly of the connector modules 130, 132, 133*a* and 133*b* to the assembly module B can then be rapidly and easily effectuated by simply plugging in the modules in mating condition with the tab terminals 108 whereby the common zone connector modules 130–133 as shown in FIG. 15 are arranged substantially perpendicularly to the tab branch connector modules 100, 100*a*, 100*b*. The keying webs 138 are inserted into the slots 122,122*a*, 122*b* and not only allow coupling together of the transverse connector modules 130–133*b*, 100–100*b*, but also provide a keying means to ensure that the modules 130, 132, 133*a* and 133*b* have unique positions within the assembly module B in order to eliminate any risk of erroneous assembly. The transverse coupling of modules 100–100*b* and modules 130–133*b* therefore provides a solution with optimum grouping of harness wires as well as rapid and error-free connection of the electrical devices to the fuse box B. Connector modules 133*a* and 133*b* are not joined in a common housing as it may be advantageous to provide certain connector modules in separate parts, for example those devices in the engine compartment may be more advantageously fed to the fuse box from separate directions due to the proximate position of the fuse box within the engine compartment.

Advantageously therefore, the modular construction, and in particular the grouping of electrical wires from different electrical devices connected to the same fuse, to a single connector module pluggable into an assembly module allows for rapid connection of electrical devices to the fuse box as well as error-free connection due to the cooperating keying means provided on the connector modules and assembly modules. Furthermore, electrical devices from different parts of a vehicle but connected to the same fuse may be grouped together in connector modules transversely matable to branch connector modules mounted in the assembly modules thereby reducing the number of connections to be made at the vehicle assembly line. These connector modules can also be provided with keying means cooperable with keying means of the fuse box assembly module so as to avoid erroneous connections. Also advantageously, is the disposition of the power supply terminals about a centre-line of the fuse box whilst disposing the terminals for connection to the various electrical devices on outer sides of the fuse box thereby avoiding crossover of the power supply and device lines, thereby rendering the wiring simple to assemble and maintain. A further advantage in providing the connector modules and assembly modules is the ability to re-use many of these parts for a different fuse box, thus allowing cost-effective variations to be produced.

I claim:

1. A fuse box assembly module for interconnecting electrical power supply lines, via electrical fuses, to device lines leading to electrical devices, characterized in that the assembly module comprises a housing comprising a cavity pluggably receiving separate branch connector modules therein, each connector module comprising a branch terminal having a fuse tab connection section, a base section and a device connection section for connection to a plurality of device lines belonging to at least two different cable harnesses, the assembly module further comprising common zone connector modules for connection to electrical conducting wires of the device lines for supplying electrical current to the devices, each common zone connector module for connection to wires of a common harness, whereby the common zone connector modules are pluggable in a transverse manner to the branch connector modules having means such that wires of different harnesses are connectable to a same fuse.

2. The assembly module of claim 1 characterized in that branch connector modules comprise insulative housings in which the branch terminals are securely received, the housings having slots extending in the direction of plugging of the common zone modules for transversely receiving the common zone modules.

3. The assembly module of claims characterized in that the common zone modules have webs interconnecting terminal housings that receive terminals connected to the device lines.

4. The assembly module of claim 3 characterized in that the webs are engageable in the slots, the complementary webs and slots positioned in distinct positions to act as keying means for preventing incorrect connection to the common zone modules to the branch module.

5. The assembly module of any of claims 1–4 characterized in that the branch terminal is a unitary stamped and formed sheet metal part.

6. The assembly module of any of claim 5 characterized in that the branch terminal comprises a plurality of tabs for connection to the common zone modules, the tabs extending from a base portion, and a receptacle contact for mating with a fuse tab, the receptacle contact extending from the base portion in a direction substantially opposed to the tabs.

7. The assembly module of claim 1 characterized in that the branch connector modules comprise insulative housings within which the branch terminals are received, the housings having keying members cooperable with complementary keying members of the assembly module housing.

8. The assembly module of any preceding claim characterized in that the assembly module comprises power terminals therein for interconnecting the power supply lines to tabs of the fuses and therethrough to the branch terminals, the power terminals stamped and formed from sheet metal and comprising a base portion from which one or more receptacle contacts extend for connection to one or more fuse tabs, and from which one or more tabs extend for connection to the power supply lines.

9. The assembly module of claim 8 characterized in that at least one of the power terminals comprises two tabs, one of the tabs for connection to an incoming power supply line and the other for interconnecting a power line leading to a power terminal of a second assembly module.

10. The assembly module of claim 9 characterized in that the power terminals have a plurality of receptacle contacts for supplying a plurality of fuses with a common power supply.

11. The assembly module of claim 8 characterized in that the module comprises only one power terminal per type of power supply necessary for the electrical devices connected to the module.

12. The assembly module of claim 9 characterized in that the tabs of the power terminals comprise different thicknesses depending on the electrical current requirements therethrough, the tab thickness being increased by providing one or more additional folds of sheet metal, whereby tabs of a common power terminal may be provided with different thicknesses.

13. The assembly module of claim 1 characterized in that the assembly module comprises at least one IDC branch connector module therein, the connector module comprising a terminal having a fuse tab connection section, a base section and an IDC branch connection section for insulation displacing connection to a plurality of conducting wires connected to the electrical devices, the connector module being pluggable and securely retainable into the assembly module housing thereby positioning the fuse tab connection section proximate an upper face of the assembly module in position for connection to a tab of the fuse.

14. An automobile fuse box assembly module for interconnecting electrical power supply lines, via electrical fuses, to device lines leading to electrical devices in different zones of the automobile, the different zones being supplied with electrical current by conducting wires of different harnesses, characterized in that the assembly module comprises a plural device housing receiving at least one IDC branch connector module therein, the connector module comprising a terminal having a fuse tab connection section, a base section and a IDC branch connection section for insulation displacing connection to a plurality of conducting wires connected to the electrical devices, the connector module being pluggable and securely retainable into the assembly module housing thereby positioning the fuse tab connection section proximate an upper face of the assembly module in position for connection to a tab of the fuse.

15. The assembly module of claim 14 characterized in that the IDC branch connector module comprises an insulative housing in which the terminal is securely received.

16. The assembly module of claims 14 or 15 characterized in that the plural device terminal is a unitary stamped and formed sheet metal part, where a plurality of IDC sections extend from the base section, each for connection to a respective conducting wire.

17. The assembly module of claim 16 characterized in that the module comprises power terminals therein for interconnecting the power supply lines to tabs of the fuses and therethrough to the branch terminals, the power terminals stamped and formed from sheet metal and comprising a base portion from which one or more receptacle contacts extend for connection to one or more fuse tabs, and from which one or more tabs extend for connection to the power supply lines.

18. The assembly module of claim 14 characterized in that at least one of the power terminals comprises two tabs, one of the tabs for connection to an incoming power supply line and the other for interconnecting a power line leading to a power terminal of a second assembly module.

19. The assembly module of claim 18 characterized in that the power terminals have a plurality of receptacle contacts for supplying a plurality of fuses with a common power supply.

20. An automobile fuse box for interconnecting power supply lines, via electrical fuses mountable on the fuse box, to lines leading to electrical devices, characterized in that the fuse box comprises assembly modules having power terminals therein for interconnecting wires of the power supply lines to tabs of the fuses, and device terminals for electrically interconnecting conducting wires of the device lines to other tabs of the fuses, whereby substantially all of the power terminals are disposed around and roughly proximate a centre-line of the fuse box whereby the device terminals are disposed substantially further outwards of the centre-line, proximate outer sides of the fuse box.

21. The fuse box of claim 20 characterized in that some of the device terminals are single device terminals for connection to a single conducting wire, the single device terminals having IDC connection sections positioned proximate cutouts in sidewalls of the fuse box assembly modules for allowing access to stuff the wires into the IDC connection sections once the single device terminals are assembled to the assembly modules.

* * * * *